US007383667B2

(12) United States Patent
Jung

(10) Patent No.: US 7,383,667 B2
(45) Date of Patent: Jun. 10, 2008

(54) EXTERIOR FACING PANEL SYSTEM FOR OUTER WALLS OF BUILDINGS

(75) Inventor: Kyu-Soo Jung, Gyeonggi-do (KR)

(73) Assignee: Samwoo EMC Co., Ltd., Seoul (KR)

( * ) Notice: Subject to any disclaimer, the term of this patent is extended or adjusted under 35 U.S.C. 154(b) by 638 days.

(21) Appl. No.: 10/948,677

(22) Filed: Sep. 24, 2004

(65) Prior Publication Data

US 2005/0183369 A1 Aug. 25, 2005

(30) Foreign Application Priority Data

Feb. 4, 2004 (KR) ..... 20-2004-0002639 U

(51) Int. Cl.
*E04B 2/88* (2006.01)

(52) U.S. Cl. ..... 52/235; 52/506.05; 52/512

(58) Field of Classification Search ..... 52/455–458, 52/448, 578, 782.1, 235, 234, 506.01, 792.1, 52/794.1, 800.1, 364, 384, 387, 474, 488, 52/733.4, 506.05, 509, 512, 489.1, 489.2, 52/285.3, 481.2, 239, 36.1, 238.1, 511, 144; 160/135, 351; 181/284; 403/240, 241, 397; 24/457, 458

See application file for complete search history.

(56) References Cited

U.S. PATENT DOCUMENTS 3,204,324 A * 9/1965 Nilsen ..... 29/897.312
3,900,996 A * 8/1975 Yohe ..... 52/241
4,107,887 A * 8/1978 Wendt ..... 52/105
4,139,974 A * 2/1979 Fox ..... 52/404.2
4,408,427 A * 10/1983 Zilch ..... 52/481.2
4,765,111 A * 8/1988 Osawa ..... 52/509
4,783,941 A * 11/1988 Loper et al. ..... 52/235
5,590,502 A * 1/1997 Wendt ..... 52/489.2
5,918,437 A * 7/1999 Dobija ..... 52/506.01
6,792,727 B2 * 9/2004 Krieger ..... 52/245

* cited by examiner

*Primary Examiner*—Robert Canfield
*Assistant Examiner*—Bryan Eppes
(74) *Attorney, Agent, or Firm*—Jacobson Holman PLLC

(57) ABSTRACT

Exterior facing panels for outer walls of the buildings including plural panels, each of the panels having a top face; side faces connected to the top face and bent downwardly from the edge of the top face; inward-bent end portions connected to the side faces and bent inwardly to the panel in a substantially right angle with respect to the side faces, and the inward-bent end portions supporting and holding an adiabatic material filed with the panels, engaging holes extending laterally across some parts of the side faces in a manner that the adjacent engaging holes of the adjacent side faces of the adjacent panels do not face oppositely with each other; and a clip having a claw for engaging with the engaging hole, a holding portion for engaging with the inward-bent end portion of the panel, a connecting portion for connecting the clip with a frame which is used for structurally holding and supporting the exterior facing panels, and an adiabatic plate attached to a bottom of the connecting portion for preventing heat or cold from transferring between the panels and frames. Preferably, in the inward-bent exterior facing panels, a size of the claw of the clip inserted into the corresponding engaging hole is smaller than that of the corresponding engaging hole.

6 Claims, 3 Drawing Sheets

EXTERIOR FACING PANEL SYSTEM FOR OUTER WALLS OF BUILDINGS

BACKGROUND OF THE INVENTION

1. Field of the Invention

This invention relates to exterior facing panels attached to outer walls of a structure such as buildings. More particularly, it relates to exterior facing panels which can be effectively prevented from deforming due to contraction or expansion thereof caused by change of outside temperature, and also which can be effectively prevented from bedewing by attaching an adiabatic plate between the exterior facing panels and an interior frame on which the panels are attached.

2. Description of the Prior Art

FIG. 5 shows an example of the exterior facing panels of prior art. In FIG. 5, the end portions (12*a*) of the side faces (11*a*) of the exterior facing panels (10*a*) are bent exteriorly (to the left direction of the side face in FIG. 5) so that the adjacent end portions (12*a*) are close or next to each other on the frame (40*a*). The end portions (12*a*) are fixed directly to the frame (40*a*) by connecting means such as fasteners. When outdoor temperature changes, the exterior facing panels suffer from contraction or expansion caused by the temperature changes and deform because the panels have no room to absorb the physical changes of contraction or expansion thereof. Therefore, in response to the change of the outer temperature, the panels become uneven in the surface. The panels tend to have bad appearance and be relatively weakened, unstable or undurable in structure and duration of use thereof are reduced. In addition, since the panels of prior art have the outward-bent end portions (12*a*) mentioned above, the panels tend to be easily damaged and to hurt bodies of workers when being handled. Moreover, the out-bent end portions (12*a*) essentially require using additional fixing tape for fixing adiabatic materials (50*a*) filled in inner portions of the panels. Furthermore, the panels having the outward-bent end portions (12*a*) are relatively inferior in loading or stocking or carrying because of their geometric structure.

SUMMARY OF THE INVENTION

In view of the problem of the prior art, it is an object of the present invention to provide the exterior facing panels having the following characteristics: the size change of the panels caused by the temperature change can be absorbed; the occurrence of bedewing on the panels or the frames can be prevented; the adiabatic materials can be filled within the panels without additional fixing tape; the panels have relatively superiority in loading, stocking, carrying or handling, and the panels are especially physically safe when handled by workers.

In accordance with the present invention, the exterior facing panels for outer walls of the buildings comprising a plurality of panels, each of the panels comprising a top face; side faces connected to said top face and bent downwardly from the edge of the top face; inward-bent end portions connected to said side faces and bent inwardly into the panel in substantially right angle with respect to said side faces, and said inward-bent end portions supporting and holding an adiabatic material filled within the panels, the side faces including engaging holes extending laterally across some parts of the side faces in a manner that the adjacent engaging holes of the adjacent side faces of the adjacent panels do not face oppositely with each other; and a clip having a claw for engaging with said engaging hole, a holding portion for engaging with said inward-bent end portion of the panel, a connecting portion for connecting the clip with a frame which is used for structurally holding and supporting the exterior facing panels, and an adiabatic plate attached to a bottom of said connecting portion for preventing heat or cold from transferring between said panels and frames.

Preferably, in the exterior facing panels, a size of the claw of the clip inserted into the engaging hole is smaller than that of said engaging hole.

BRIEF DESCRIPTION OF THE DRAWINGS

A preferred embodiment of the present invention will be discussed in detail below with reference to the attached drawing figures.

Figure 1:
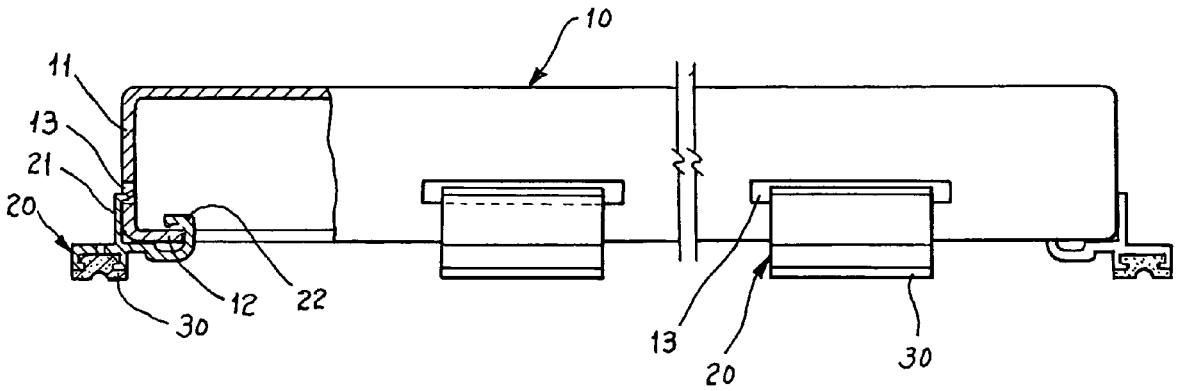
FIG. 1 is a partially broken-away sectional side view of an exterior facing panel in accordance with an embodiment of the present invention.

The brief description of reference numerals of drawings is as follows:

| | |
|---|---|
| 10: Exterior facing panel | 11: Side faces |
| 12: Inward-bent end portions | |
| 13: Engaging holes | 20: Clips |
| 21: Claw | 22: Holding portion |
| 23: Connecting Portion | 30: Adiabatic plate |
| 40: Frames | 50: Adiabatic Material |

DESCRIPTION OF THE PREFERRED EMBODIMENT

Hereinafter, a preferred embodiment of the present invention will be described with reference to the accompanying drawings.

Figure 2:
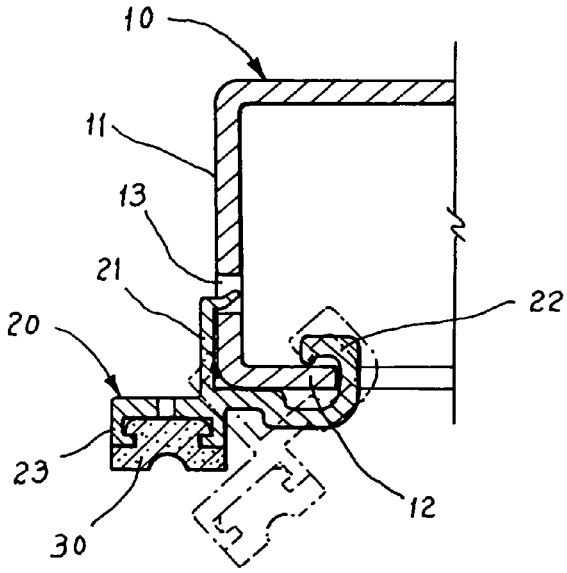
FIG. 2 is a partially enlarged sectional side view of the exterior facing panel in accordance with an embodiment of the present invention.

Referring to FIGS. 1 and 2, each of the exterior facing panels (10) has a top face, four side faces (11) connected to the top face and bent downwardly, and inward-bent end portions (12) connected to the side faces (11) and bent inwardly to the panels (to the right direction of FIGS. 1, 2 and 3), in right angle with respect to the side faces (11). Engaging holes (13) are formed on, and extended laterally across some parts of the side faces (11), preferably, located on the positions adjacent to corners of the side faces (11) in such manner that the adjacent engaging holes (13) of adjacent opposite side faces (11) of adjacent panels (10) do not face with each other, as shown in FIG. 4. As a result, adjacent clips (20)(described below) of adjacent panels (10) can be engaged with the corresponding engaging holes (13), and fixed on the frames (40) without interfering with each other.

Each of the clips (20) comprises a claw (21) for detachably, idly, and firmly engaging with the corresponding engaging hole (13), a holding portion (22) for firmly holding the inward-bent end portion (12) of the panel (10), and a connecting portion (23) for connecting the clip (20) with the frame (40) with, for example fasteners, such as a screw.

Also, the clip (20) has an adiabatic plate (30) attached to the bottom thereof. The claw (21) of the clip (20) has a bent end inserted to the engaging hole (13).

In addition, the holding portion (22) of the clip (20) has a bent end firmly fixed to the inward-bent end portion (12) of the panel (10). Preferably, sizes of the claws 21 are smaller than those of the engaging holes (13) so that the space formed between the engaging holes (13) and the claws (21) can absorb contraction or expansion of the panel caused by the temperature change, as described above.

Figure 3:
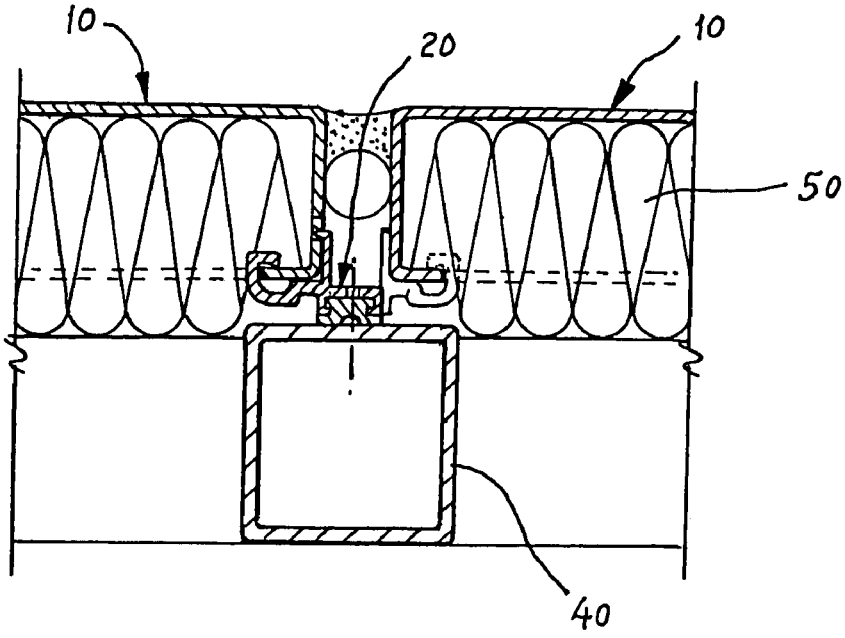
FIG. 3 is a sectional side view showing the exterior facing panels of the present invention installed on the frames.
Figure 4:
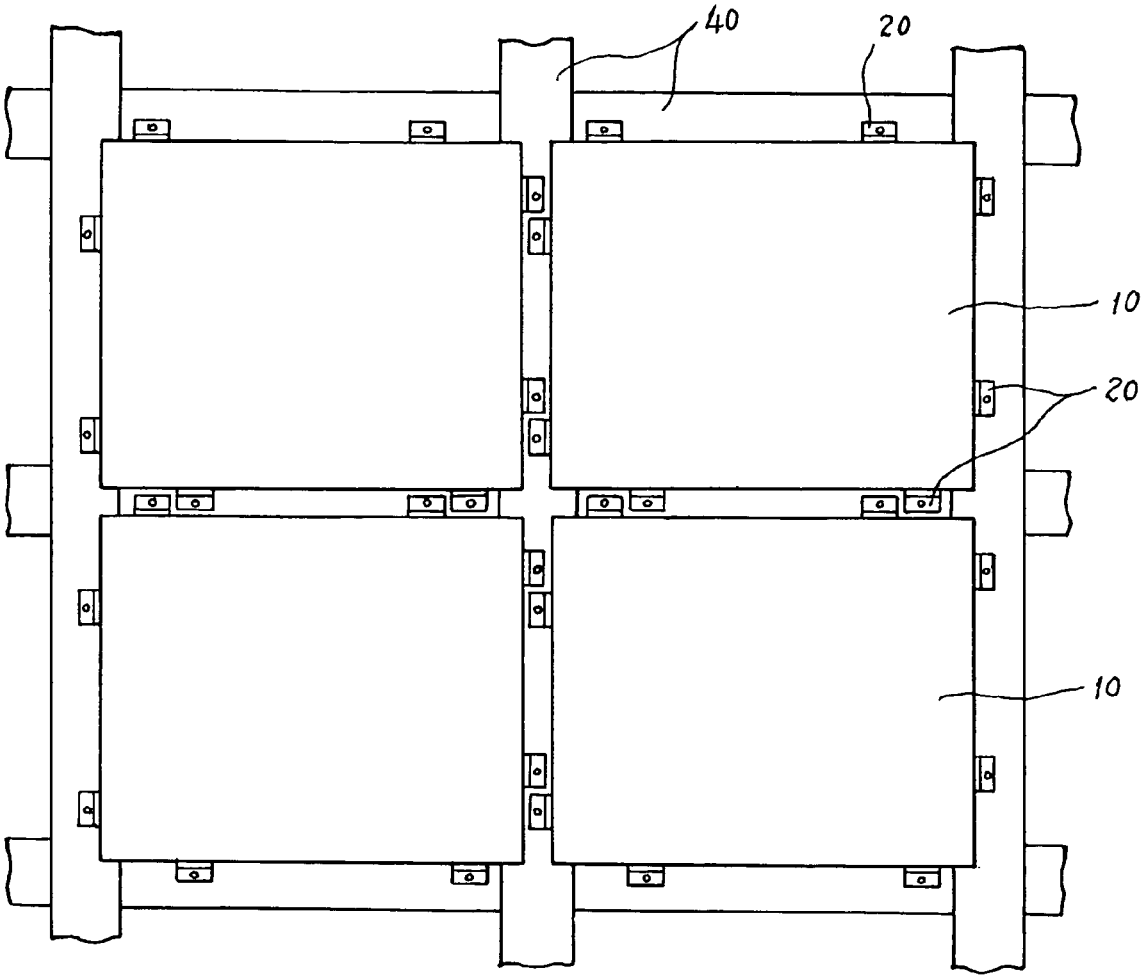
FIG. 4 is a plan view showing the exterior facing panels of the present invention installed on the frames.

FIG. 3 is a sectional view showing the exterior facing panels (10) installed on the frames (40), and FIG. 4 is a plan view showing the plural exterior panels (10) installed on the frames (40).

As shown in FIGS. 3 and 4, each clip (20) is fixed on the frame (40) via the adiabatic plate (30) by, for example, fasteners. The adjacent clips (20) of the adjacent panels (10) do not face and contact with each other. They are located laterally side by side.

The adiabatic plates (30) attached to the bottom of the clips (20) can prevent heat or cold from transferring between the panels (10) and the frames (40).

Figure 5:
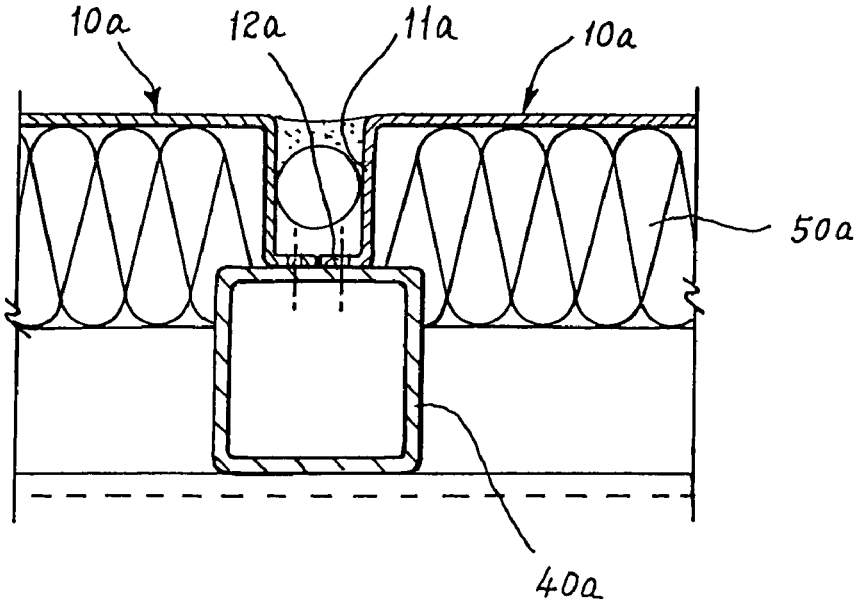
Fig. 5 PRIOR ART
FIG. 5 is a sectional side view showing the exterior facing panels of the prior art installed on the frames.

Finally, the reference numerals 50 in FIG. 3 of the present invention and in FIG. 5 of prior art indicate all the adiabatic materials filed within box-like panels (10).

In accordance with the panels of the present invention mentioned above, the present invention has the following characteristics:

First, since the sizes of the engaging holes (13) are larger than those of the ends of the claws that are inserted in the engaging holes, the spaces formed between the engaging holes and the inserted ends of claws can absorb the side change of the panels in both vertical and horizontal directions according to contraction or expansion caused by temperature change.

Therefore, the panels of the present invention can keep evenness and good appearance in the surfaces thereof and can maintain relatively good durability and long life.

Second, the adiabatic plates (30) of the clip (20) can effectively prevent bedewing by insulating the heat or cold transferred between the frames (40) and the panels (10) via the clips (20).

Third, since the panels (10) have box-like shapes in part by inwardly bending the end portions (12), the adiabatic materials can be received and effectively fixed therein without additional fixing tapes which is essentially required in the panels of prior art material, because the inward-bent end portions (12) of the panels (10) can support and fix the adiabatic materials received within the box-like panels.

Fourth, the outward-bent end portions (12*a*) of prior art frequently have physically injured workers, and tends to be damaged by contacting them with other articles when workers handling the panels of the prior art. However, in the present invention, there is nearly no possibility to hurt workers by the inward-bent end portions (12) or to damage the panel by contacting other articles.

Fifth, the panels of the present invention are relatively superior to those of prior art in loading, stocking, carrying, or handling because the geometric structure of the inward-bent end portions thereof.

What is claimed is:

1. Exterior facing panel system for outer walls of buildings, each of the panels comprising:

a top face;

at least one side face connected to said top face and bent downwardly from the edge of the top face, said side face including engaging holes extending laterally across some parts of the side face in a manner that the adjacent engaging holes of an adjacent side face of an adjacent panel do not face oppositely with each other; and at least one inward-bent end portion connected to said side face and bent inwardly from said side face and extending only partially coextensive with said top face to form a terminal edge separated by an empty space from said top face, said inward-bent end portion extending at a substantially right angle with respect to said side faces; and a clip having a claw for engaging with said engaging hole, a holding portion for engaging with said inward-bent end portion of the panel and surrounding said terminal edge to project into the empty space between said top face and said inward-bent end portion, and a connecting portion for connecting the clip with a frame which are used for structurally holding and supporting the exterior facing panels.

2. The exterior facing panel system as claimed in claim 1, wherein a size of the claw of the clip inserted into the corresponding engaging hole is smaller than that of said corresponding engaging hole.

3. The exterior facing panel system as claimed in claim 1, wherein said inward-bent end portion supports and holds an adiabatic material filled within the panel.

4. The exterior facing panel system as claimed in claim 1, wherein said clip further comprises an adiabatic plate attached to bottom of said connecting portion for preventing heat or cold from transferring between said panel and frame.

5. Exterior facing panel system for outer walls of buildings, each of the panels comprising:

a top face;

at least one side face connected to said top face and bent downwardly from the edge of the top face, said side face including engaging holes extending laterally across some parts of the side face in a manner that the adjacent engaging holes of an adjacent side face of an adjacent panel do not face oppositely with each other;

at least one inward-bent end portion connected to said side face and bent inwardly from said side face and extending only partially coextensive with said top face to form a terminal edge separated by an empty space from said top face, said inward-bent end portion extending at a substantially right angle with respect to said side faces, said inward-bent end portion supporting and holding an adiabatic material filled within the panel; and;

a clip having a claw for engaging with said engaging hole, a holding portion for engaging with said inward-bent end portion of the panel and surrounding said terminal edge to project into the empty space between said top face and said inward-bent end portion, and a connecting portion for connecting the clip with a frame which are used for structurally holding and supporting the exterior facing panels, and an adiabatic plate attached to bottom of said connecting portion for preventing heat or cold from transferring between said panel and frame.

6. The exterior facing panel system as claimed in claim 5, wherein size of the claw of the clip inserted into the corresponding engaging hole is smaller than that of said corresponding engaging hole.

* * * * *